US005810672A

United States Patent [19]

Gorsiski

[11] Patent Number: 5,810,672

[45] Date of Patent: Sep. 22, 1998

[54] CORNER ATTACHMENT FOR BILLIARD TABLE RAILS

[76] Inventor: Glenn Gorsiski, 7424 Lakeshore Dr., Racine, Wis. 53402

[21] Appl. No.: 681,831

[22] Filed: Jul. 29, 1996

(Under 37 CFR 1.47)

[51] Int. Cl.[6] ..... A63D 15/00

[52] U.S. Cl. ..... 473/31

[58] Field of Search ..... 473/31

[56] References Cited

U.S. PATENT DOCUMENTS

| | | | |
|---|---|---|---|
| 723,378 | 3/1903 | Fuller | 473/31 |
| 851,493 | 4/1907 | Castonquay | 473/31 |
| 3,138,387 | 6/1964 | Michel et al. | 473/31 |

*Primary Examiner*—Theatrice Brown
*Attorney, Agent, or Firm*—Wood, Phillips, VanSanten, Clark & Mortimer

[57] ABSTRACT

Inaccuracies in rail alignment in a billiard table are eliminated and the process of installing rails on a billiard table simplified with a rail assembly for a billiard table that includes first and second elongated rails (10, 44) which are adapted to be mounted on the upper surface of a bed (68) of a billiard table with each having an inwardly directed resilient nose (12, 46) defining a cushion. The rails (10, 44) are arranged in end-to-end relation and define an angle of 90° with innermost parts (16, 42) of adjacent ends of each rail (10, 44) being at an angle of 45° to the direction of elongation of the associated rail (10, 44) and generally parallel with each other and with outermost parts (14, 50) of the adjacent ends defining two sides of an outwardly opening V-shaped notch. A Y-shaped mitre (20) is sandwiched by the adjacent ends and has a leg (22) located between and engaging the innermost parts (16, 42) and diverging arms engaging respective sides (14, 50) of the V-shaped notch. Fasteners (34) secure each arm (24, 26) to its respective side (14, 50) to maintain a desired angular relationship between the rails (10, 44).

11 Claims, 1 Drawing Sheet

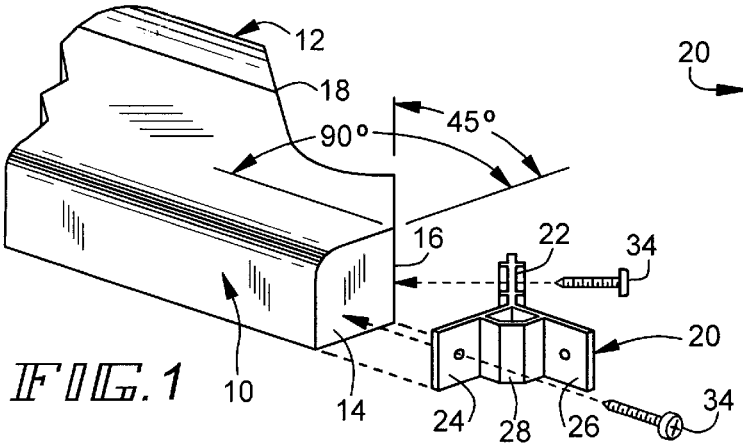
FIG. 1
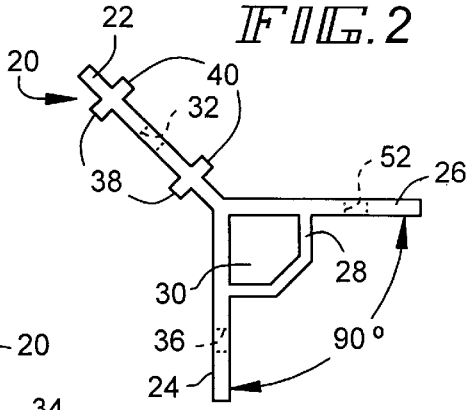
FIG. 2
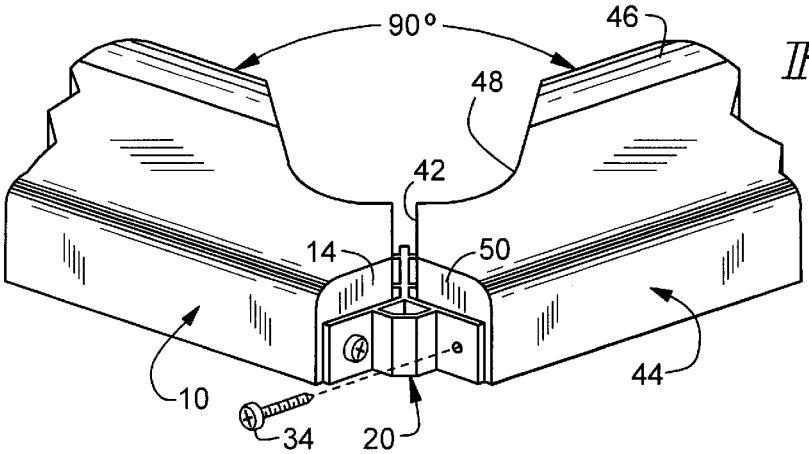
FIG. 3
FIG. 4
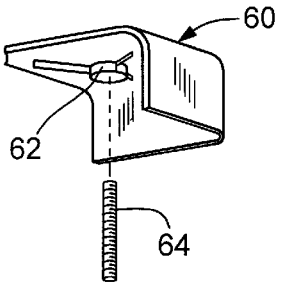
FIG. 5
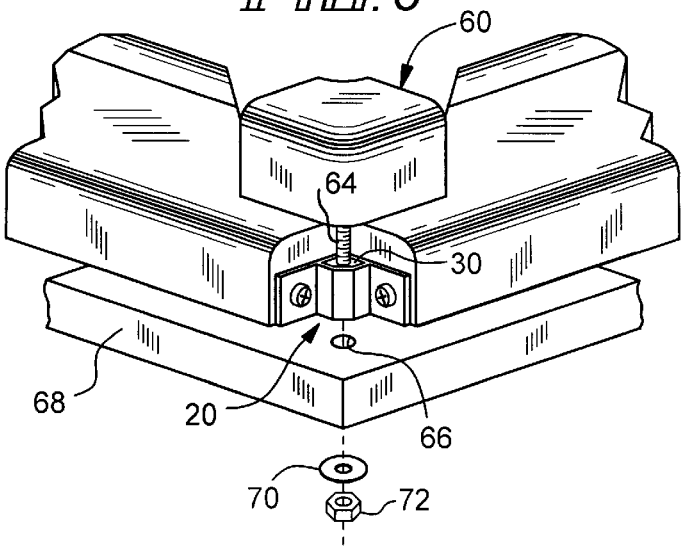

CORNER ATTACHMENT FOR BILLIARD TABLE RAILS

FIELD OF THE INVENTION

This invention relates to billiard tables, and more particularly, to a means for assembling the rails of a billiard table to each other.

BACKGROUND OF THE INVENTION

It has often been said that billiards is a game of angles. As a consequence, it is necessary that the surfaces of the table from which balls may carom which are conventionally termed "cushions" and which are mounted on rails that extend about the periphery of the bed of the table be accurately angularly located with respect to one another. For example, in a conventional table, it is absolutely necessary that the side rail be exactly at 90° to the end rails and vice versa. Any other geometry could affect the ability of a player to accurately place a shot, particularly if one or more of the balls is intended to carom off of two or more cushions.

As a consequence, it has been customary to use a carpenter's square in the process of assembling one rail to another. This introduces a measure of tediousness into the assembly process while still allowing for erroneous assembly if the rails themselves are not properly oriented with respect to the carpenter's square. Specifically, it is necessary to hold a side and an end rail together while maintaining them square using the carpenter's square which is positioned against the cushions. Conventionally, a corner tie plate is secured to the rail corner mitre. Then, the corner tie plate is secured to the rails using threaded fasteners. If, at any point during assembly process, alignment with the carpenter's square is lost, the proper orientation of the end rail to the side rail may be lost.

There is, therefore, a real need for a simpler, easier to use and more accurate corner attachment for the rails of a billiard table.

SUMMARY OF THE INVENTION

It is the principal object of the invention to provide a new and improved billiard table. More specifically, it is an object of the invention to provide a new and improved corner attachment assembly for the rails of a billiard table.

An exemplary embodiment of the invention achieves the foregoing objects in a construction that includes first and second elongated rails, each adapted to be mounted on the upper surface of a bed of a billiard table and each having an inwardly directed resilient, elongated nose defining a cushion. The rails are arranged in end-to-end relation and define an angle of less than 180° with the innermost parts of adjacent ends of each rail being at an angle of less than 90° to the direction of elongation of the associated rail and generally parallel with each other. Outermost parts of adjacent ends of the rails define two sides of an outwardly opening V-shaped notch. A Y-shaped mitre is sandwiched by the adjacent ends of the rails and has a leg located between and engaging the inner-most parts and diverging arms engaging respective sides of the V-shaped notch. Fasteners secure each arm to its respective side to orient the rails with respect to one another and maintain a desired angular relation between the rails.

In one embodiment, the angle between the rails is 90° and the angle of less than 90° to 45°. The two sides of the notch are at an angle of 90° to one another as are the arms of the Y-shaped mitre.

According to a preferred embodiment, a brace element extends between the arms of the Y-shaped mitre intermediate the ends thereof and defines an opening in the Y-shaped mitre. Further included is a corner mitre for covering the joint between the rails and the Y-shaped mitre. A fastener extends from the corner mitre and through the opening to secure the corner mitre to the bed of a billiard table.

Other objects and advantages of the invention will become apparent from the following specification taken in connection with the accompanying drawings.

DESCRIPTION OF THE DRAWINGS

FIG. 1 is an exploded view illustrating the end of one rail and a Y-shaped mitre made according to the invention used for securing such rail to another rail;

FIG. 2 is a plan view of the Y-shaped mitre;

FIG. 3 is a view of two rails assembled to one another;

FIG. 4 is an exploded view of a corner mitre used in the invention; and

FIG. 5 is an exploded view of the application of the corner mitre to the assembled rails.

DESCRIPTION OF THE PREFERRED EMBODIMENT

An exemplary embodiment of a billiard table made according to the invention is shown in fragmentary form in the drawings and includes a rail assembly made according to the invention. With reference to FIG. 1, an elongated rail, generally designated 10, which may be the head or foot rail or otherwise referred to as an end rail, is provided. The rail 10 is elongated and on its innermost side includes an elongated nose 12 which is formed of a resilient material and is customarily referred to as a cushion. Each end of the rail 10 includes an outermost end face 14 which is cut precisely at 90° to the direction of elongation of the rail 10 as shown in FIG. 1. An innermost face 16 is cut at 45° to the face 14 as well as to the direction of elongation of the rail 10. Inwardly of the face 16 is an arcuate cut 18 which defines half of a corner pocket. The cut 18 will be employed only when the table is a pocket billiard table and will be omitted entirely if the table is a conventional billiard table.

A Y-shaped mitre, generally designated 20, includes a leg 22 from which two arms 24 and 26 extend. In addition, a brace 28 interconnects the arms 24 and 26 intermediate their ends to strengthen the same. Preferably, the Y-shaped mitre 20 is formed of an aluminum extrusion and its construction, with typical dimensions in inches is illustrated in FIG. 2. It will be seen that the brace 28 and the innermost parts of the arms 24 and 26 define an opening 30.

The leg 22, intermediate its ends includes an opening 32 which, as seen in FIG. 1, may receive a threaded fastener such as a headed screw 34 for fastening the leg 22 to the face 16 of the end of the rail 10.

Similarly, the arm 24, outwardly of the brace 28, includes an aperture 36 which, as seen in FIG. 1, may also receive a threaded fastener such as a screw 34 whereby it may be fastened to the face 14 of the rail 10.

A pair of small teeth 38 and 40 are located on each side of the leg 22 and serve as locating teeth. The teeth 38 embrace the face 16 while the teeth 40 will embrace a similar face 42 (FIG. 3) on a side rail, generally designated 44, which is also provided with a cushion 46 at its innermost extreme and which is also provided with an arcuate notch 48 to define the remainder of a corner pocket.

The end face 42 of the rail 44 is also at 45° to the direction of elongation of the rail 44 to be parallel to the face 16 while an outermost part the end of the rail 44 defines a face 50 which is at 90° to the direction of such elongation. The faces 14 and 50 define an outwardly opening V-shape at the intersection of the rails 10 and 44. A threaded fastener 34 may extend through an aperture 52 in the arm 26 to be threaded into the face 50 of the rail 44.

In a typical table, the rails 44 and 10 will be at 90° to one another as illustrated in FIG. 3. This means the faces 14 and 50 will be at 90° to one another and to this end, as illustrated in FIG. 2, the arms 24 and 26 are at 90° to one another. Of course, in some unusual forms of billiard tables, bumper pool for example, the rails may not be at 90° to one another and so the angular relationships mentioned hereinabove will be altered appropriately. Similarly, for any type of billiard game, the faces 14 and 50 could be at an angle other than 90° to one another, but for simplicity sake, it is preferred that both be at the same angle to the direction of elongation of the corresponding rail so that the position of the arms 24 and 26 on the Y-shaped mitre 20 will be symmetrical allowing installation with the arm 24, for example, either on the left as illustrated in FIG. 1 or on the right, not shown.

In general, it will be desirable to install the components with the lower edges of the rail 10 and 44 in the same plane as the lower side of the Y-shaped mitre 20.

Turning now to FIGS. 4 and 5, FIG. 4 illustrates a somewhat cup shaped, partial housing termed a "corner mitre" and generally designated 60. The corner mitre 60 includes an integral, threaded sleeve 62 which is adapted to receive a threaded stud 64 as illustrated in FIG. 4. The corner mitre 60 is sized to fit over the joint provided by the Y-shaped mitre 20 as illustrated in FIG. 5. The stud 64 is located so as to extend through the opening 30 in the Y-shaped mitre 20 to pass through an opening 66 in the bed 68, typically slate, of the billiard table. A washer 70 and nut 72 may be threaded on the stud 64 thereby securing the corner mitre 60 in place.

Additional, conventionally located studs may be associated with each of the rails 10 and 44 and the bed 68 for securing the rails to the bed.

From the foregoing, it will be appreciated that the rail assembly of the present invention does not require the use of a tool such as a carpenter's square to assure proper alignment of the rails 10 and 44 with respect to one another. Simply by properly forming the faces 14, 16, 42, 50 and appropriately orienting the arms 24 and 26 of the Y-shaped mitre on the leg 22 thereof, an accurate joint with any desired angle between the rails 10 or 44 is readily achieved. As noted, it is preferred that the Y-shaped mitre 20 be symmetrical so that it may be installed with either side up without effecting the resulting alignment.

It will also be appreciated that the proper alignment is achieved simply by the process of tightening the threaded fasteners 34 when securing the rails 10 and 44 to each other via the Y-shaped mitre 20. Thus, one need not be concerned with maintaining the proper alignment during the securing process as is the case with prior art rail corner assembly methods.

I claim:

1. A rail assembly for a billiard table comprising:

first and second elongated rails, each adapted to be mounted on the upper surface of a bed of a billiard table and each having an individually directed resilient, elongated nose defining a cushion;

said rails being arranged in end to end relation and defining an angle of less than 180° with innermost parts of adjacent ends of each rail being at an angle of less than 90° to the direction of elongation of the associated rail and generally parallel with each other and outermost parts of said adjacent ends defining two sides of an outwardly opening V-shaped notch;

a Y-shaped mitre sandwiched by said adjacent ends and having a leg located between and engaging said innermost parts and diverging arms engaging respective sides of said V-shaped notch; and fasteners securing each arm to its respective side to orient said rails with respect to one another and maintain a desired angular relation between the rails.

2. The rail assembly of claim 1 including an arcuate notch located in both said rails at the innermost parts of said adjacent ends and defining the opening for a billiard pocket.

3. The rail assembly of claim 1 wherein the angle between said rails is 90° and said angle of less than 90° is 45°, and said two sides and said two arms are all at an angle of 90° to each other.

4. The rail assembly of claim 3 wherein each of said arms includes an aperture, and said fasteners are threaded fasteners extending through corresponding ones of said apertures.

5. The rail assembly of claim 4 wherein a brace element extends between said arms intermediate the ends thereof and defines an opening in said Y-shaped mitre; and further including a corner mitre for covering the joint between said rails and said Y-shaped mitre, and a fastener extending from said corner mitre and through said opening to secure said corner mitre to the bed of a billiard table.

6. The rail assembly of claim 5 wherein said leg includes a transverse hole and further including a fastener extending through said hole into one of said adjacent ends of said rails.

7. The rail assembly of claim 6 wherein said leg includes a pair of locating teeth extending from each side thereof into engagement with a respective one of said adjacent end.

8. The rail assembly of claim 1 wherein each of said arms includes an aperture, and said fasteners are threaded fasteners extending through corresponding ones of said apertures.

9. The rail assembly of claim 8 wherein a brace element extends between said arms intermediate the ends thereof and define an opening in said Y-shaped mitre; and further including a corner mitre for covering the joint between said rails and said Y-shaped mitre, and a fastener extending from said corner mitre and through said opening to secure said corner mitre to the bed of a billiard table.

10. The rail assembly of claim 9 wherein said leg includes a transverse hole and further including a fastener extending through said hole into one of said adjacent ends of said rails.

11. The rail assembly of claim 8 wherein said leg includes a pair of locating teeth extending from each side thereof into engagement with a respective one of said adjacent end.

* * * * *